United States Patent [19]

Otto, Jr. et al.

[11] Patent Number: 4,593,551

[45] Date of Patent: Jun. 10, 1986

[54] ROLLING PROCEDURES FOR ALLIGATOR DEFECT ELIMINATION

[75] Inventors: William L. Otto, Jr., Allegheny Township, Allegheny County; Neal L. Lawson, Monroeville; Howard A. Kuhn, Richland Township, Lebanon County, all of Pa.

[73] Assignee: Aluminum Company of America, Pittsburgh, Pa.

[21] Appl. No.: 658,157

[22] Filed: Oct. 5, 1984

Related U.S. Application Data

[63] Continuation-in-part of Ser. No. 532,705, Sep. 16, 1983, abandoned.

[51] Int. Cl.[4] ..... B21B 31/20

[52] U.S. Cl. ..... 72/240; 72/365

[58] Field of Search ..... 72/240, 365, 366

[56] References Cited

U.S. PATENT DOCUMENTS

| | | | |
|---|---|---|---|
| 4,290,288 | 9/1981 | Kawakubo | 72/240 |
| 4,502,311 | 3/1985 | Eibe | 72/240 |

FOREIGN PATENT DOCUMENTS

| | | | |
|---|---|---|---|
| 91908 | 7/1981 | Japan | 72/240 |
| 32502 | 2/1983 | Japan | 72/240 |
| 61901 | 4/1983 | Japan | 72/240 |

*Primary Examiner*—Francis S. Husar
*Assistant Examiner*—Jorji M. Griffin
*Attorney, Agent, or Firm*—Elroy Strickland

[57] ABSTRACT

A method of reducing the thickness of a slab of metal under conditions that tend to produce alligator defects in the ends of the slab, the method comprising the steps of tapering at least one end of the slab and directing the same into a rolling mill. The tapered end of the slab is reduced in thickness in the mill, the amount of reduction increasing as the tapered end passes through the mill. The slab continues through the mill to reduce the thickness of the same. The end of the slab is again tapered and directed again through a rolling mill, with each of said tapers providing combinations of entry thickness to thickness reduction such that the reduction taken in the area of each taper is in an entry thickness to thickness reduction zone that does not produce alligatoring in the ends of the slab. The remaining untapered portion of the slab is reduced in thickness in the mill in an entry thickness to thickness reduction zone in which alligator formation tends to occur.

2 Claims, 5 Drawing Figures

ROLLING PROCEDURES FOR ALLIGATOR DEFECT ELIMINATION

CROSS-REFERENCE TO RELATED APPLICATION

This application is a continuation-in-part of U.S. application Ser. No. 532,705, filed Sept. 16, 1983 now abandoned.

BACKGROUND OF THE INVENTION

The present invention relates generally to the thickness reduction of metal slabs, and particularly to a method that reduces the thickness of slabs in a manner that avoids alligatoring in the ends of the slabs.

Large ingot that is slated for reduction in thickness for purposes of being rolled in a rolling mill to make sheet or plate products typically requires "breakdown" in a rolling mill. Breakdown rolling involves numerous passes of the ingot through the mill, usually a reversing mill, at temperatures in the range of about 250° C. to about 550° C. for aluminum ingot. This provides a slab of the metal. After appreciable amounts of reduction involving several passes of the slab through the mill, fractures tend to occur in the ends of the slab. The fractures extend in a plane that is essentially parallel with the rolled surfaces of the slab and are centrally located between such surfaces.

Such fracturing, or alligatoring, as it is known in the rolling art, may be caused by the internal stress state of the slab which results from the nonuniformity of the deformations that take place in the initial passes. As the breakdown rolling proceeds, the internal stresses are considerable and might be sufficient to open up a slab which contains either central defects or is of limited ductility, as in the case of a slab of the aluminum 8% magnesium alloy.

Whatever the cause of alligatoring, the subject matter of the present invention is directed to substantially limiting the occurrence of such alligatoring, if not preventing the same altogether. It can be appreciated that with the occurrence of alligatoring a substantial amount of scrap is generated, as the split portions of the slab must be removed from the main body thereof before the slab is further reduced. The removal of the split ends also increases costs by increasing the breakdown rolling time for each ingot, which lowers productivity. Control or elimination of alligator formations would reduce scrap losses and rolling time, and thus would improve the efficiency of the breakdown rolling process.

BRIEF SUMMARY OF THE INVENTION

The present invention is directed to the discovery of certain parameters in regard to the thickness of the slab being rolled in a mill in relation to the amount of reduction in thickness taken in each pass in the breakdown process, in combination with the provision of tapered ends in the slab for each pass of the slab through the mill. The taper of the ends maintains a reduction process in an entry thickness to thickness reduction combination that is not subject to alligatoring. When the main body of the ingot is reduced in thickness, alligatoring is not a problem, as alligatoring must start at an end. In this manner, the main body can be reduced by an entry thickness to thickness reduction combination that is much higher and one that would normally produce alligatoring in the ends of the slab.

THE DRAWINGS

The invention, along with its advantages and objectives, will be best understood from consideration of the following detailed description and the accompanying drawings in which.

PREFERRED EMBODIMENT

Figure 1:
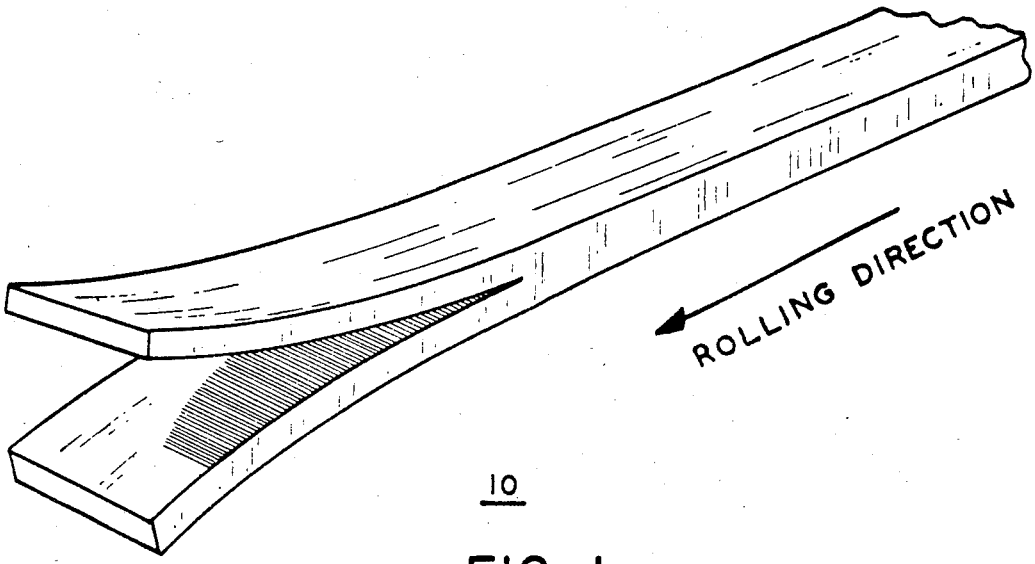
FIG. 1 is a partial view of a slab, in perspective, showing an end of the slab split apart.

Referring now to the drawings, and particularly FIG. 1 thereof, the end of a slab of metal 10 is depicted as being split apart. This shows the problem encountered in reducing the thicknesses of ingots and slabs of metal.

Figure 2:
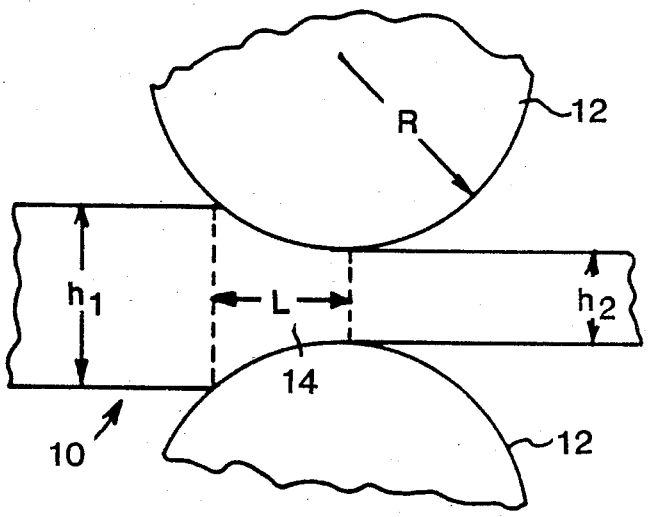
FIG. 2 shows, in partial elevation, the work rolls and work zone of a breakdown rolling mill.

FIG. 2 of the drawings shows in partial elevation two work rolls 12 of a rolling mill (not otherwise shown) and a slab of metal 10 in the process of being directed through the work zone 14 of the work rolls. The work zone has a length L that extends from the location at which slab 10 engages the work rolls as it enters zone 14 (from the left in FIG. 2) to the location at which the slab ceases to contact the rolls at the right thereof in FIG. 2. The average thickness of the slab in the work zone can be defined by the formula:

$$h \approx (h_1 + h_2)/2 \tag{1}$$

where $h_1$ is the thickness of the slab entering the work zone, and $h_2$ is the thickness of the slab leaving the work zone.

Figure 3:
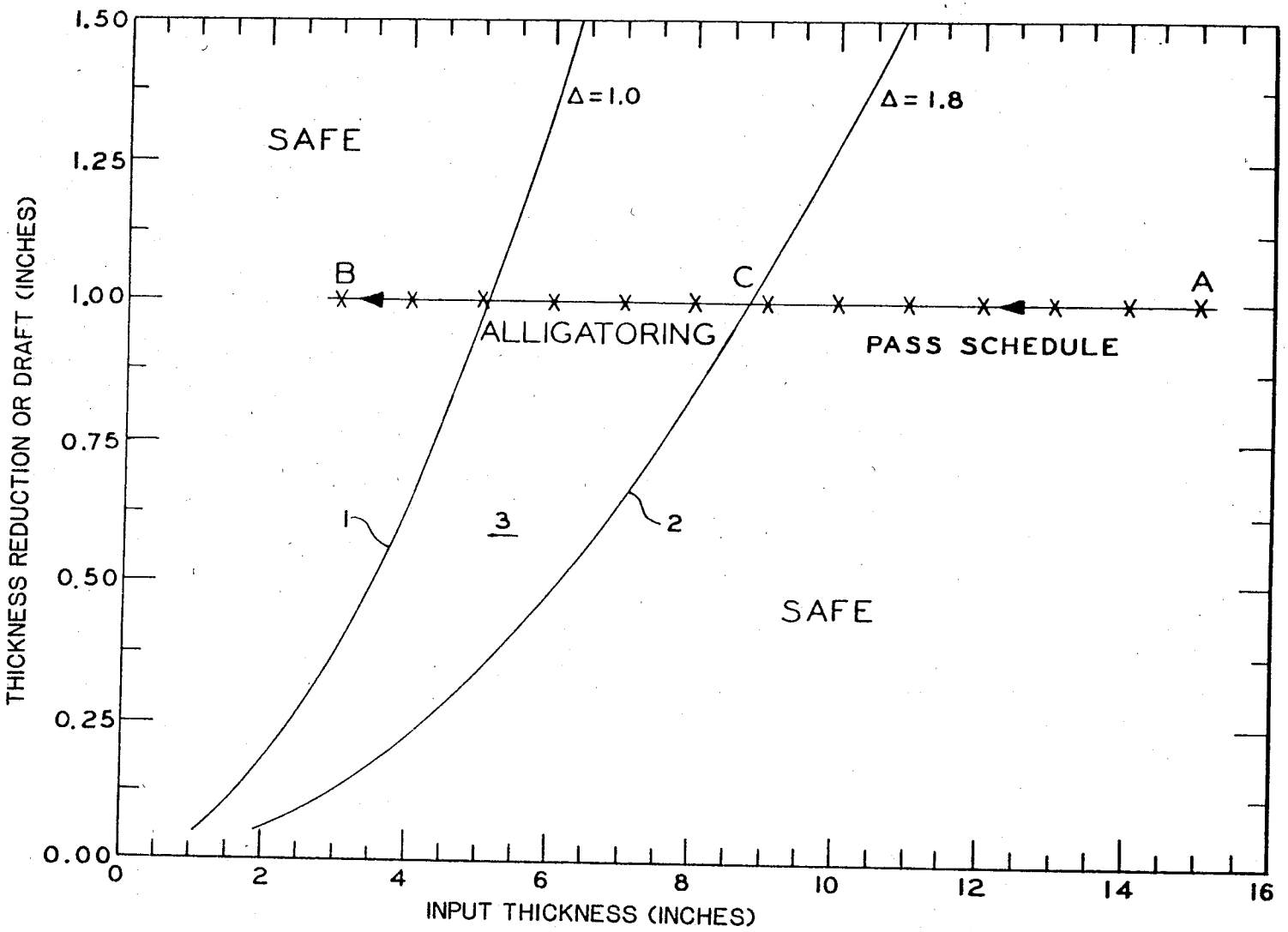
FIG. 3 shows plots of experimental data that establishes the criteria describing the rolling conditions in reference to alligator fractures.

FIG. 3 of the drawings is a graph showing two solid line curves 1 and 2 that represent the results of experimental data developed from rolling slabs in a breakdown mill. The abscissa of the graph indicates input thicknesses (in inches) of a slab to be reduced in thickness, while the ordinate of the graph represents drafts or reductions in thickness (in inches) taken by the mill when a slab is directed therethrough. Hence, the two curves define combinations of slab entry thickness and thickness reduction, and a zone 3 of input thickness versus draft, in which alligator defects tend to occur. Either side of zone 3 are the "safe" zones where alligators do not occur.

The two curves of FIG. 3 are developed from the equation:

$$h_1 = \Delta\sqrt{R(h_1 - h_2)} + (h_1 - h_2)/2 \tag{2}$$

where $\Delta$ is the ratio of the average thickness of a slab in a work zone of a rolling mill to the length of the work zone, $h_1$ and $h_2$ are respectively the entry and exit thicknesses of the slab, as indicated in FIG. 2, $h_1$–$h_2$ is the thickness reduction or draft effected in the work zone, and R is the radius of the work rolls of the mill.

$\Delta$, i.e., the delta value, being a ratio is dimensionless.

The above formula (2) is derived from the formula:

$$\Delta \approx \sqrt{h_o/4Rr}\,[2 - r] \tag{3}$$

disclosed on page 88 of the textbook "Deformation Processing" by Walter A. Backofen, published in 1972 by Addison-Wesley Publishing Company. This latter formula defines the basic feature of the channel between the work rolls of a mill in terms of the mean thickness to length ratio of the plastic work zone or area that fills the channel. The term "$h_o$" is that of "$h_1$" (entry thickness) in equation (2), and "r" is the reduction $$(h_1 - h_2)/h_1 \tag{4}$$

A straight line ACB is shown on the graph of FIG. 3 to denote a pass schedule in which constant, one-inch (on the ordinate of graph) reductions in thickness of a slab or workpiece are taken in "breaking down" an ingot. On line ACB are a series of X's, the X's representing input thickness and the amount of reduction taken in each pass.

It will be noted that curve 1 in FIG. 3 describes a boundary on the left that represents $\Delta = 1.0$, while curve 2, on the right, represents $\Delta = 1.8$. Between these two curves is a zone 3 in which alligatoring fractures tend to occur. On the left-hand side of curve 1, and on the right-hand side of curve 2, the reductions taken on an ingot are in a "safe" zone with regard to the formation of alligator fractures. For example, if one-inch reductions taken on ingots that are greater than approximately 8.75 inches in thickness, as represented on the A (right-hand) side of curve 2, the ends of the ingot will not experience the alligator phenomenon. The ends of such an ingot will, however, form such fractures when one-inch reductions are taken on ingots of 8.75 inches in thickness, down to about 5.10 inches in thickness; on the graph of FIG. 3 the alligatoring tendency begins adjacent point C and continues for about three one-inch passes (X's) in zone 3.

When the one-inch reductions move to a point beyond curve 1 (on the left) and toward point B on the graph, alligatoring ceases or tends not to occur.

Figure 4:
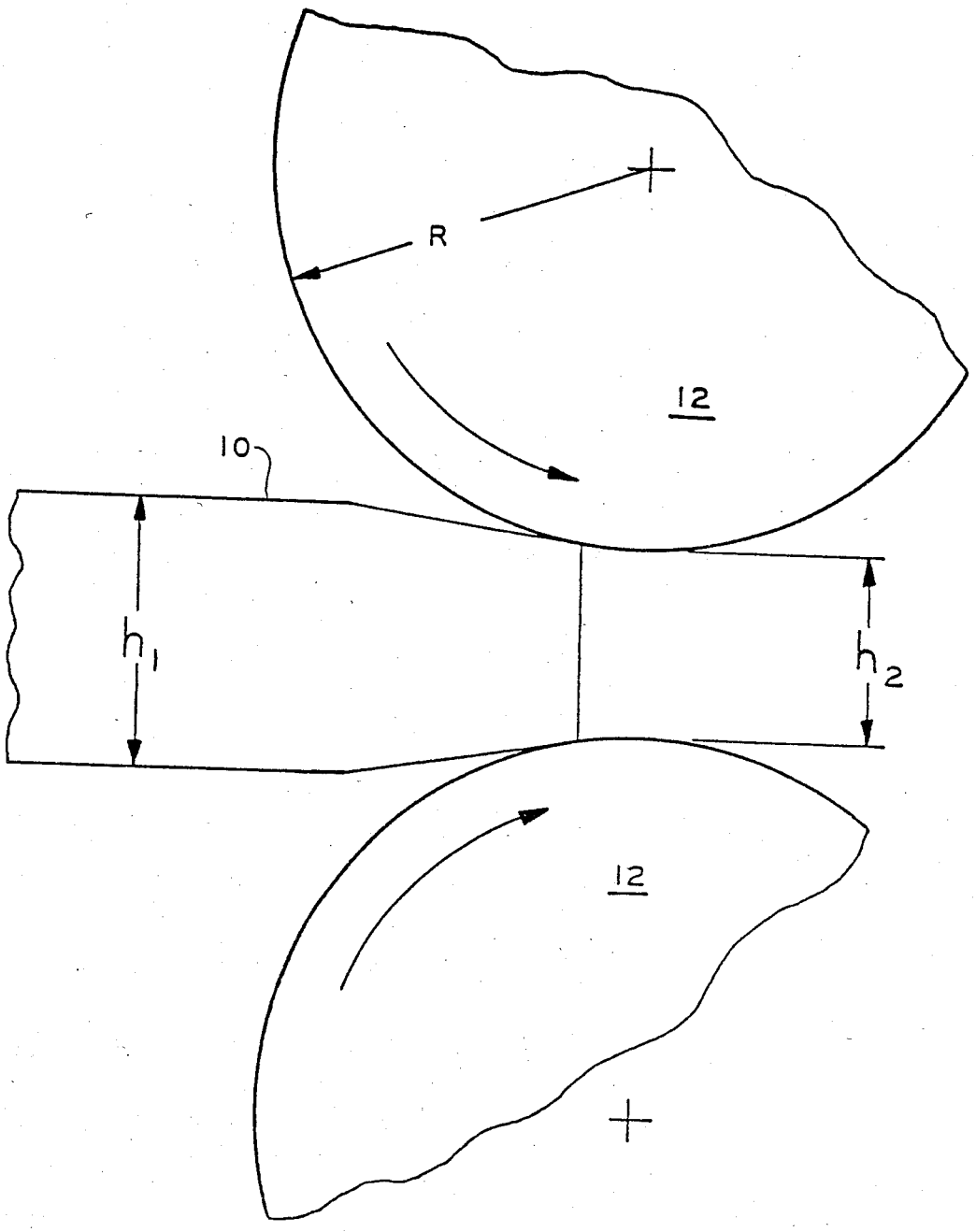
FIG. 4 shows the tapered end of a slab in a rolling mill.

Referring now to FIG. 4, a slab of metal 10 is partially depicted, with one end thereof located in the bite of a set of work rolls 12 of a rolling mill (not otherwise shown).

One end of slab 10 in FIG. 4 is shown tapered. The taper is effected by gradually reducing the roll gap of a rolling mill as the end of the slab leaves the mill and/or enters into the mill. The gap of the mill is changed in size by appropriate control of jacks, hydraulic cylinders or mechanical screws (not shown) of the mill that mechanically translate the mill rolls toward and away from each other.

Each end of slab 10 may be tapered, as both ends of a slab are subject to fracturing longitudinally and laterally along a center plane of the ends when certain relationships exist between the thickness of the slab entering the mill (entry thickness) and the amount of reduction taken in the mill (draft). These relationships are explained in terms of the above equation (2).

FIG. 5 shows again the two curves 1 and 2 of FIG. 3. These are plots of the entry thickness versus thickness reduction from equation (2). The present invention utilizes the relationships depicted in FIG. 5 to roll slabs in a manner that substantially avoids the formation of alligator fractures in the ends of the slabs.

This is accomplished by the tapers provided in FIG. 4 and then by rolling tapered slabs (10) in a manner that gradually reduces the thickness of the tapered ends as they enter and leave the mill.

Figure 5:
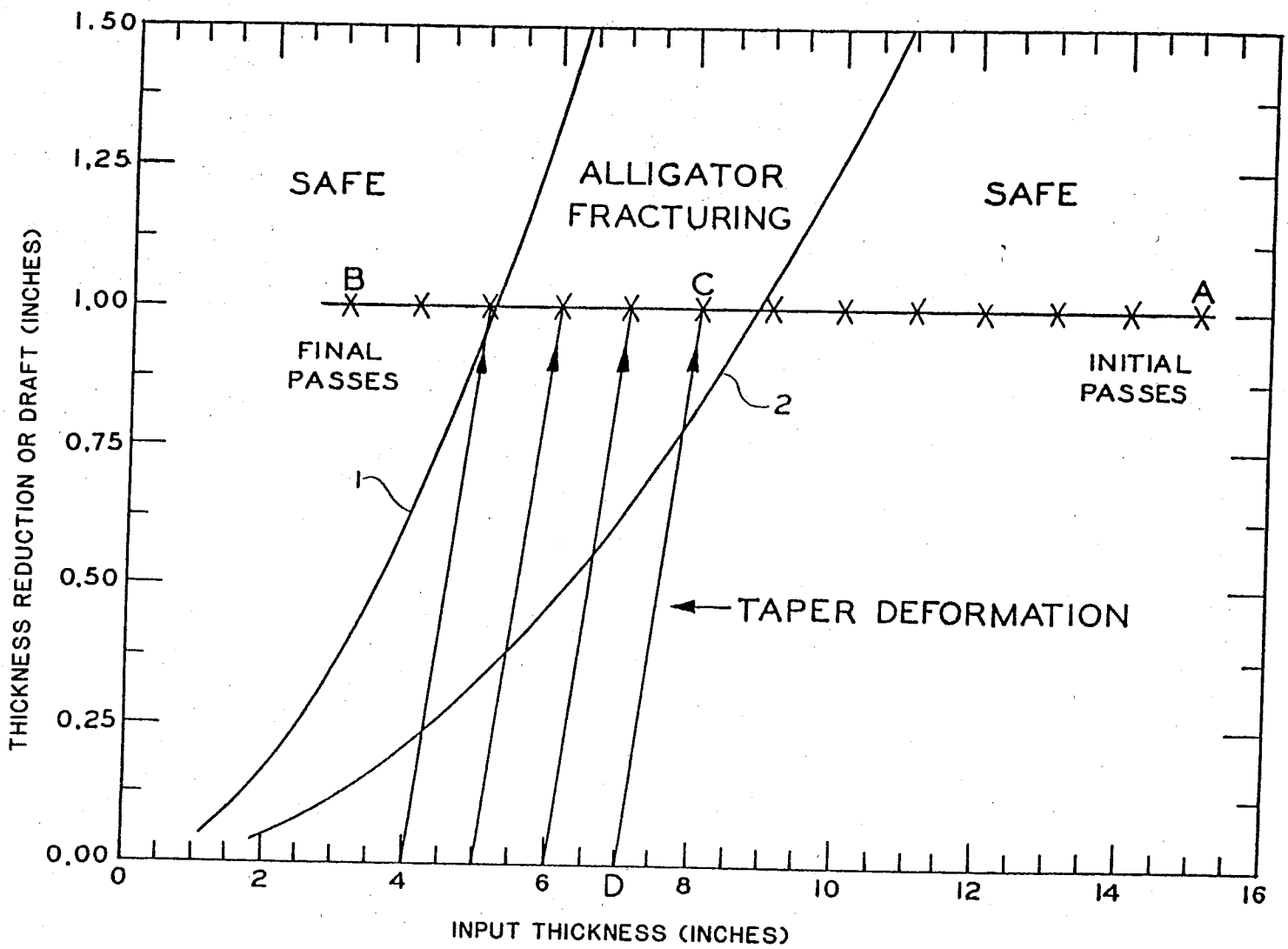
FIG. 5 is a graph showing parameters for control and elimination of alligator fractures in the ends of a tapered slab being reduced in thickness.

The nature of the process is explained in reference to the graph of FIG. 5. At the one-inch position on the ordinate of the graph is a series of X's located on a straight line ACB. Each X represents a pass of an ingot through a rolling mill in the breakdown process. The reduction taken in the ingot by each pass, as shown in FIG. 5, is then on the order of one inch, the beginning thickness of the ingot being about 15 inches (at point A on the graph).

In proceeding to the left in FIG. 5, the reductions (X's) are shown as being constant, though they need not be, as reductions in ingot thickness in the area to the right of curve 2 do not subject the ingot to alligatoring fractures.

When the thickness of the ingot reaches about eight inches in FIG. 5 and before the next reduction is taken, the ingot, which is now a slab (10), is tapered in the manner of FIG. 4 such that the extreme end of the slab is about seven inches thick. The tapered seven-inch end of the slab is now fed into the work rolls 12 of a mill for the next reduction. No reduction occurs at this end of the slab, as it enters the mill because the amount of reduction to be taken on the slab overall, the thickness of which is eight inches, is one inch. Hence, in the graph of the process, as depicted in FIG. 5, the end of the slab entering the mill is indicated by point D (seven inches) on the abscissa and the zero reduction point on the ordinate.

As the tapered end of the slab proceeds into the mill, the end is subjected to a gradual increase in the amount of reduction in thickness taken since the eight-inch thickness dimension of the main body of the slab is being approached. See line DC in FIG. 5. Since the reduction taken is one inch, the thickness of the slab is reduced to seven inches as it moves through the mill. In other words, the reduction taken changes from zero (at the tapered end) to one inch.

In going from point D on the graph to point C, it will be noted that the majority of the reduction taken with the tapered end lies in the "safe" zone located to the right of curve 2. When point C is reached, which lies in the zone in which alligator fractures occur, the slab 10 is into the rolling mill a distance that removes the end of the slab from consideration. Since alligatoring is limited to the ends of the slab, there is no problem of alligatoring when the main body of the slab is in the mill; this is the case at point C on the graph.

Before the next reduction (X) taken in slab 10, the slab is again tapered on the order of one inch, the seven-inch thick slab is now tapered to six inches at the extreme end thereof. The slab is again passed through a rolling mill, and a reduction of one inch in thickness is taken on the slab. The six-inch end of the slab experiences no reduction at all, but as the end proceeds through the mill, the ends are gradually reduced in the manner represented by curve 2 in FIG. 5. Again, as with the seven-inch taper, the majority of the reduction is taken when the six-inch taper is in the "safe" zone with respect to alligatoring. The remainder of the reduction is taken in the alligator zone, but the main body of the slab is now in the mill such that alligatoring is not a problem.

The same procedure is followed with the next pass (X), with the end of the slab being tapered to five inches before the pass takes place. However, the majority of the pass length is now in the danger zone, though alligator fracture does not form for the above reasons, i.e., the main body of slab is into the mill before the problem zone is reached.

For the four-inch taper, the problem zone occupies the majority of the pass length, though the pass begins and ends in the safe zones, which are to the right of curve 2 and to the left of curve 1.

The final passes (at B in FIG. 5) do not involve tapering the slab since the slab end deformation is in the safe zone.

While the invention has been described in terms of preferred embodiments, the claims appended hereto are intended to encompass all embodiments which fall within the spirit of the invention.

What is claimed is:

1. A method of reducing the thickness of a slab of metal in a rolling mill without causing alligatoring in the end of the slab entering the mill, alligatoring being the result of certain combinations of entry thickness and reduction of thickness, the reduction process requiring multiple reductions in thickness of the slab during respective multiple passes of the slab through the mill, the method comprising the steps of:

determining before each pass of a slab a combination of entry thickness and thickness reduction therefor that is not subject to alligatoring, providing the slab with an end portion that has such a combination, the combination being effected by tapering the end portion before each pass, leaving the remaining portion of the slab untapered, directing each tapered portion into the mill for each reduction in thickness, reducing the thickness of each slab in a manner such that the tapered portion passes though the mill before a combination of entry and reduction thickness occurs that can cause alligatoring, reducing in thickness the remaining untapered portion of the slab with each pass, and completing each pass without the occurrence of alligatoring and until the combination of entry and reduction thickness is not subject to alligatoring, at which time the tapering of the slab end for each pass becomes unnecessary.

2. The method of claim 1 in which the combination of entry to reduction thickness that can cause alligatoring for each pass is determined by two curves described by the following equation:

$$h_1 = \Delta \sqrt{R(h_1 - h_2)} + (h_1 - h_2)/2$$

where $\Delta$ is the average thickness of slab/length of roll gap and equals 1.0 and 1.8, $h_1$ and $h_2$ are respectively the entry and exit thicknesses of the slab, $h_1 - h_2$ is the thickness reduction or draft of a rolling mill, and R is the radius of the work rolls of the mill.

* * * * *